US006889662B2

(12) United States Patent
Hess

(10) Patent No.: US 6,889,662 B2
(45) Date of Patent: May 10, 2005

(54) FUEL PUMP, IN PARTICULAR FOR AN INTERNAL COMBUSTION ENGINE WITH DIRECT INJECTION

(75) Inventor: Manfred Hess, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/419,237

(22) Filed: Apr. 21, 2003

(65) Prior Publication Data

US 2004/0016420 A1 Jan. 29, 2004

(30) Foreign Application Priority Data

May 7, 2002 (DE) ..... 102 20 281

(51) Int. Cl.[7] ..... F02M 37/04; F04B 53/10

(52) U.S. Cl. ..... 123/467; 123/446; 417/454; 137/512

(58) Field of Search ..... 123/446, 467, 123/510; 137/511, 512, 535, 540, 543; 417/454, 490, 499

(56) References Cited

U.S. PATENT DOCUMENTS 4,905,729 A * 3/1990 Kawamura ..... 137/539.5
5,015,160 A * 5/1991 Hlousek et al. ..... 417/499
5,176,175 A * 1/1993 Farnham et al. ..... 137/614.18
5,584,314 A * 12/1996 Bron ..... 137/239
5,605,449 A * 2/1997 Reed ..... 417/454
5,636,975 A * 6/1997 Tiffany et al. ..... 417/454
5,839,414 A * 11/1998 Klinger et al. ..... 123/467

* cited by examiner

*Primary Examiner*—Thomas Moulis
(74) *Attorney, Agent, or Firm*—Ronald E. Greigg

(57) ABSTRACT

A fuel pump for use in a fuel injection system includes a housing at least one piston defining a work chamber and drive means which put the piston into a reciprocating motion in the chamber. An inlet conduit and an outlet conduit can be made to communicate with the work chamber. A first valve device is provided between the inlet conduit and the work chamber, and a second valve device is provided between the work chamber and the outlet conduit. The valve element of one valve device has a guide portion, which is received in a guide opening embodied in the valve element of the other valve device, and the circumferential face of the guide portion and/or of the guide opening has at least one recess, by which the contact area between the guide portion and the guide opening is reduced.

20 Claims, 5 Drawing Sheets

FUEL PUMP, IN PARTICULAR FOR AN INTERNAL COMBUSTION ENGINE WITH DIRECT INJECTION

BACKGROUND OF THE INVENTION

1. Field of the Invention

The invention relates first to a fuel pump, in particular for an internal combustion engine with direct injection, having a housing, having at least one piston which is received in the housing, having drive means, which put the piston into a reciprocating motion, having a work chamber which is defined in some regions by the piston, having an inlet conduit and having an outlet conduit, which can be made to communicate with the work chamber, having a first valve device between the work chamber and the inlet conduit and a second valve device between the work chamber and the outlet conduit, wherein the valve element of one valve device has a guide portion, which is received at least in some regions in a guide opening.

2. Description of the Prior Art

A fuel pump known on the market serves as a high-pressure fuel pump for Diesel engines of motor vehicles. The fuel is pumped at high pressure by the high-pressure fuel pump into a fuel collection line ("rail"), in which it is stored under high pressure. From the rail, the fuel reaches injection valves, which inject directly into the combustion chambers of the engine.

In the known fuel pump, the two valve devices are accommodated in a compact unit. The valve element of the valve device ("inlet valve") between the work chamber and the inlet conduit is braced on the valve element of the valve device ("outlet valve") between the work chamber and the outlet conduit. The valve element of the inlet valve is also guided, via a cylindrical guide peg, in a guide opening of the valve element of the outlet valve.

In the known engine, it has been found that in operation, pressure surges repeatedly occur in the inlet conduit of the fuel pump and the components located downstream of it. These pressure surges reduce the efficiency of the fuel pump. The valves are also complicated to manufacture. Moreover, regulation is difficult because of the pressure fluctuations.

Furthermore, in internal combustion engines there is the fundamental necessity of being able to suppress the pumping of fuel into the rail completely ("zero feeding"). Since a metering unit also used for the purpose, disposed upstream of the high-pressure fuel pump, even in the closed state always allows a certain leakage quantity of fuel to reach the high-pressure fuel pump, so-called zero-feed throttles are used between the metering unit and the high-pressure fuel pump, which are intended to return the leak fuel emerging from the outlet of the metering unit. By means of these zero-feed throttles, however, the starting performance of the engine is adversely affected. Without such zero-feed throttles, on the other hand, even with the metering unit completely closed, fuel would continue to be pumped from the high-pressure fuel pump to the rail.

OBJECT AND SUMMARY OF THE INVENTION

The present invention has the object of refining a fuel pump of the type defined at the outset in such a way that the engine in which it used can be manufactured more economically and has better starting performance, and in which a secure shutoff of fuel pumping is assured.

In a fuel pump of the type defined at the outset, this object is attained in that the guide opening is embodied in the valve element of the other valve device, and the circumferential face of the guide portion and/or of the guide opening has at least one recess, by means of which the contact area between the guide portion and the guide opening is reduced.

In the fuel pump of the invention, in the inlet conduit and upstream of it, pressure pulses originating in the fuel pump no longer occur. Thus valves that can be made more economically can be used.

The starting performance of an engine which is equipped with the fuel pump of the invention is also improved considerably, since the zero-feed throttles can be markedly smaller than before. In the fuel pump of the invention, specifically, even if a metering unit disposed upstream of the fuel pump allows a certain leakage quantity of fuel to reach the fuel pump, still no fuel is pumped.

The reason for both provisions is that the functions of the inlet valve and the outlet valve in the fuel pump of the invention are decoupled from one another. In the known fuel pump, it has in fact been found that whenever the outlet valve opens during a pumping stroke, the effects of friction and a delayed pressure buildup in the receiving opening of the valve element of the outlet valve causes the inlet valve to open briefly. This leads to the pressure surge or pressure pulse in the inlet region of the fuel pump, which is avoided in the fuel pump of the invention.

In a multi-cylinder fuel pump whose inlet conduits communicate with one another, this pressure pulse tripped during a pumping stroke of one cylinder causes opening of the valve element of the inlet valve at the other cylinder, which at that instant is in the intake phase. Thus during the intake phase of this cylinder, fuel reaches the work chamber, and during the ensuing pumping stroke it is transported onward to the rail.

This is avoided in the fuel pump of the invention, since because of the reduced friction between the valve elements of the inlet and outlet valves, the aforementioned slaving effect cannot occur. The inlet valve of a cylinder that at that instant is in the pumping phase remains reliably closed.

The decoupling of the valve element of the inlet valve from the valve element of the outlet valve is attained by reducing the contact area between the two elements. As a result, the friction between two elements is reduced, which finally means that the valve element of the outlet valve is not slaved upon a motion of the valve element of the inlet valve. According to the invention, a "mechanical" decoupling is accordingly created.

In an advantageous feature of this fuel pump, it is proposed that it has a connecting conduit, which connects the guide opening with the work chamber. A connecting conduit of this kind prevents a pressure drop, upon a motion of the valve element of the outlet valve, in the guide opening, which could also provoke a motion of the valve element of the inlet valve, from occurring. As a result of this connecting conduit, the harmful pressure pulses are prevented even better. According to the invention, a "hydraulic" decoupling is accordingly created.

As an alternative, in a fuel pump of the type defined at the outset, it is possible for the guide portion to be embodied on the valve element of the first valve device and the guide opening to be embodied in the inlet conduit. As a result, the two valve elements are completely decoupled from one another, so that an opening motion of the valve element of the inlet valve provoked by the opening motion of the valve element of the outlet valve is precluded. In contrast to the above two embodiments of the invention, however, the valve element of the outlet valve must be made somewhat shorter under some circumstances, so as to assure the requisite spacing between the two valve elements upon an opening motion of the valve element of the inlet valve.

In a first refinement, the circumferential face of the guide portion and/or of the guide opening has at least one longitudinally extending recess, by which the contact area between the guide portion and the guide opening is reduced and which acts as a flow conduit when the valve device is open. In this refinement, the complete decoupling of the two valve elements and especially low-friction guidance of the valve element of the inlet valve are thus combined with one another.

It is possible for there to be a plurality of recesses. The more recesses there are, the smaller is the contact area between the guide portion and the guide opening, which finally leads to a reduction in the frictional forces. Furthermore, the flow in the region of the valves is improved by a plurality of recesses.

It is especially preferred if the recesses are embodied such that between the guide portion and the guide opening, only an essentially linear contact exists. In this case, the frictional forces between the guide portion and the guide opening are minimal. However, care must be taken to assure that the contact areas are still large enough that excessive wear does not occur.

In an especially preferred feature of the fuel pump of the invention, it is proposed that the guide portion is embodied such that it includes at least three radially extending vanes, which are preferably distributed over the circumference. With such vanes, on the one hand secure guidance of the valve element is possible, and on the other, the recesses or openings between the vanes make a largely unhindered flow of the fuel possible. Such a fuel pump thus operates at high efficiency.

The same is true for a fuel pump in which the guide opening is embodied such that it includes at least three radially extending vanes, which are preferably distributed over the circumference.

It is advantageous if the vanes are ground hollow. This increases the stability of the valve element and creates a larger flow cross section.

It is also proposed that the valve element of the first valve device is braced on the valve element of the second valve device via a clamping element in such a way that it is pressed against the associated seat. Such a fuel pump is very compact in structure.

The engagement of the clamping element with the first valve element is facilitated by the provision that the first valve element includes a plate-shaped support portion, preferably a disk, on which the clamping element is braced.

BRIEF DESCRIPTION OF THE DRAWINGS

The invention will be better understood and further objects and advantages thereof will become more apparent from the ensuing detailed description, taken in conjunction with the drawings, in which.

DESCRIPTION OF THE PREFERRED EMBODIMENTS

Figure 1:
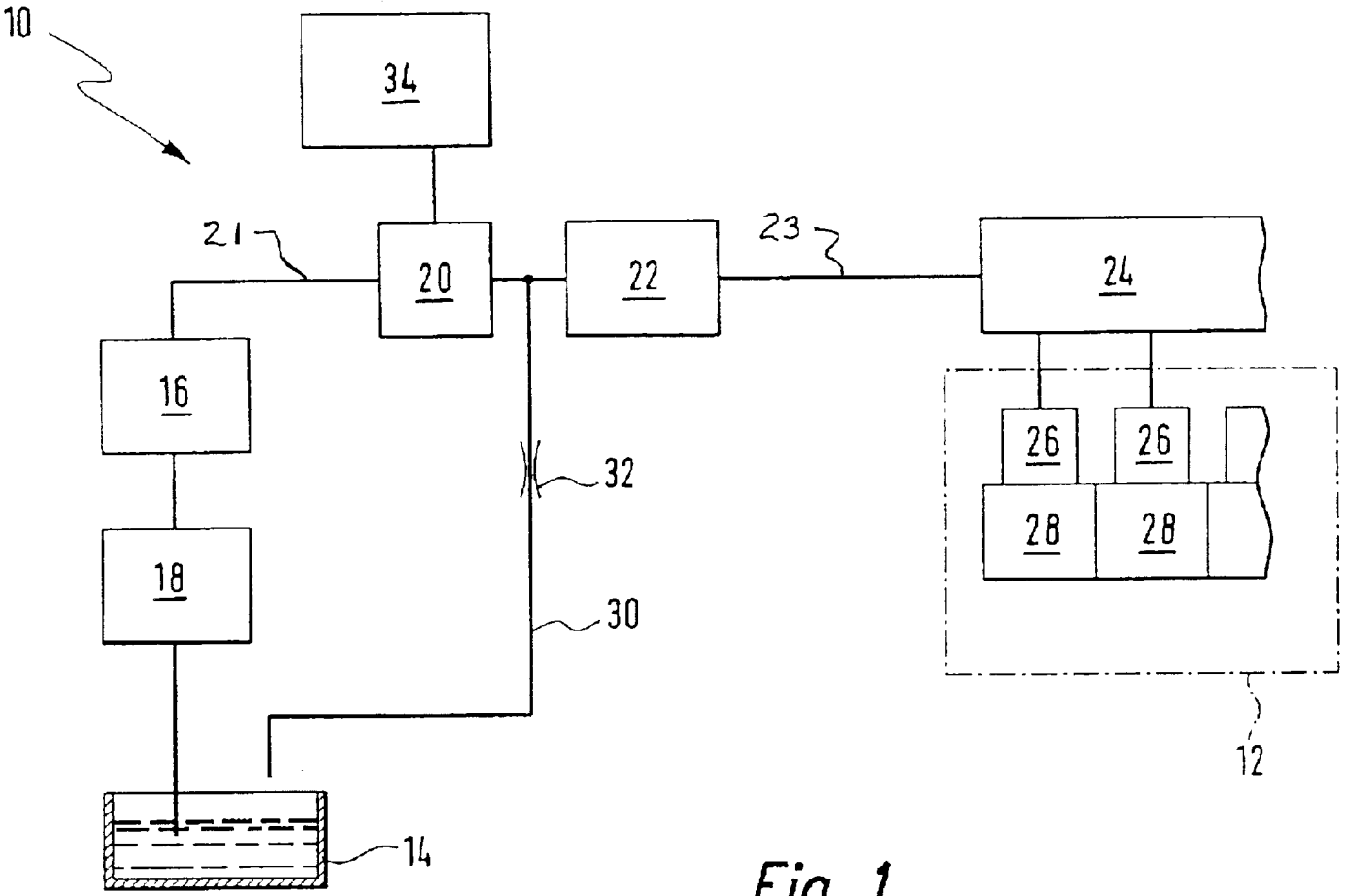
FIG. 1 is a schematic illustration of a fuel system embodying the invention in a direct-injection internal combustion engine with a high-pressure fuel pump.

In FIG. 1, a fuel system identified overall by the reference numeral 10 serves to supply an internal combustion engine 12 with fuel. The engine 12 is in this case a Diesel engine, but in principle the fuel system 10 shown can also be used for gasoline engines.

The fuel system 10 includes a fuel tank 14, from which a mechanical fuel pump 16, embodied as a geared pump, pumps fuel via a filter 18. From the fuel pump 16, via a metering unit 20 and a fuel line 21, the fuel reaches a high-pressure fuel pump 22. From there, it is pumped onward via a fuel line 23 into a fuel collection line 24 ("rail"), in which the fuel is stored at high pressure.

A plurality of injectors 26 are connected to the rail 24 and inject the fuel directly into combustion chambers 28. From the fuel line 21, a zero-feed line 30 in which a zero-feed throttle 32 is disposed branches off between the metering unit 20 and the high-pressure fuel pump 22. The essential functions of the engine 12 are controlled and regulated by a open- and closed-loop control unit 34. Thus the metering unit 20 is likewise connected to the open- and closed-loop control unit 34 and is triggered by it.

Figure 2:
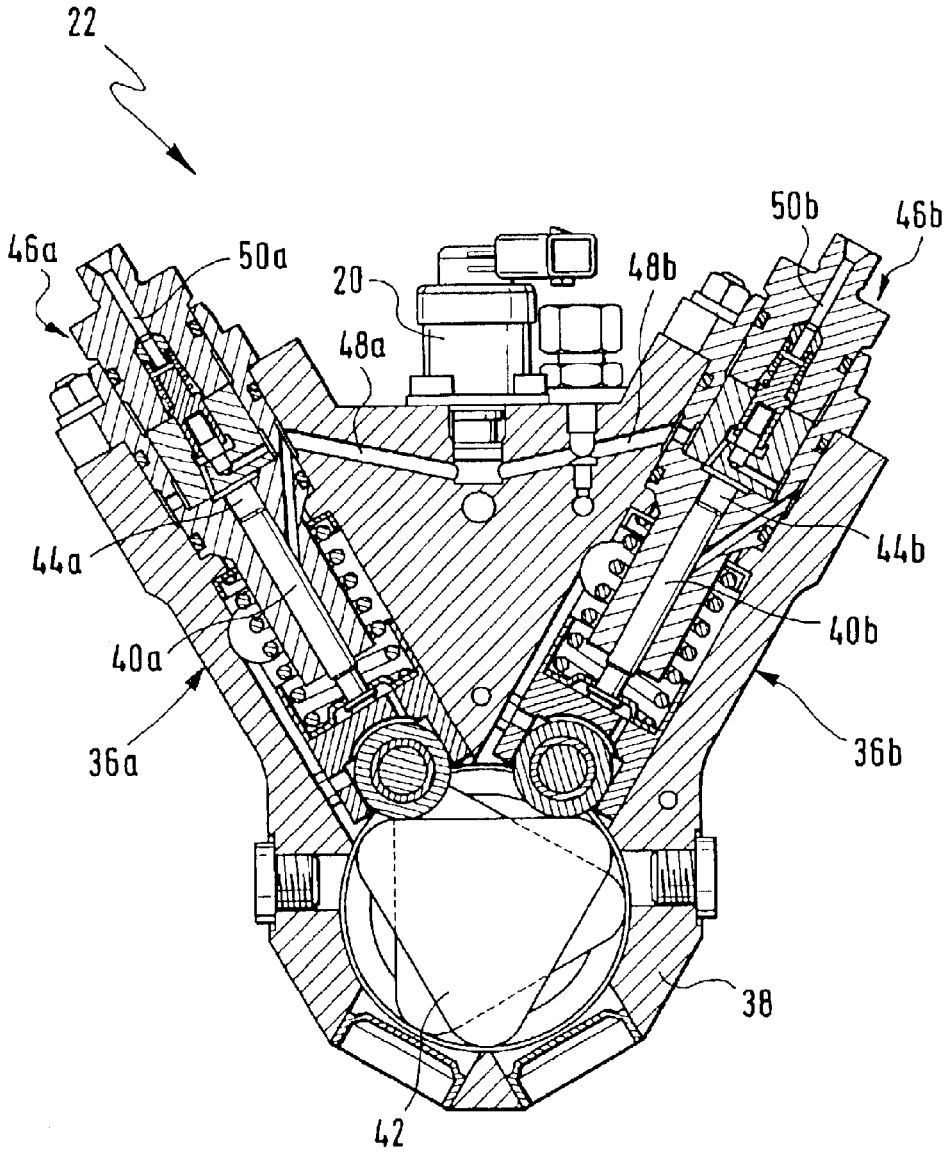
FIG. 2 is a view, partly in section, of the high-pressure fuel pump of the fuel system of FIG. 1.

The high-pressure fuel pump 22 is a 4-die high-pressure pump in a V arrangement (FIG. 2). This is used especially in fuel systems with a high fuel demand. In FIG. 2, the two cylinders of one cylinder plane can be seen. They are identified by the reference numerals 36*a* and 36*b*. The cylinders 36*a* and 36*b* are part of a housing 38. Pistons 40*a* and 40*b*, respectively, are received in them. These pistons are set into a reciprocating motion by a camshaft 42. The pistons 40*a* and 40*b* define respective work chambers 44*a* and 44*b*.

The work chambers 44*a* and 44*b* are bounded radially outward by valve blocks 46*a* and 46*b*, respectively. The structure of these valve blocks is described in further detail hereinafter. The metering unit 20 is seated on the housing 38 between the cylinders 36*a* and 36*b*. From the metering unit, inlet conduits 48*a* and 48*b* in the housing 38 lead to the valve blocks 46*a* and 46*b*, respectively. Outlet conduits 50*a* and 50*b* are present in the respective valve blocks 46*a* and 46*b*. They lead to the fuel line 23 and on to the rail 24.

Figure 3:
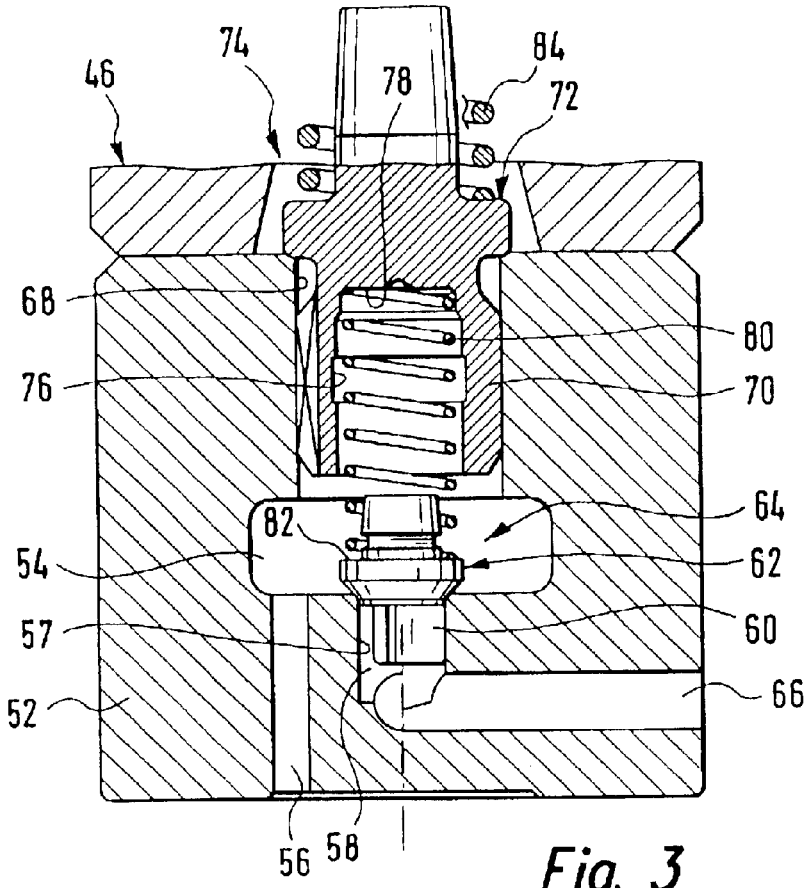
FIG. 3 is a detail of the high-pressure fuel pump of FIG. 2, in which one inlet valve and one outlet valve are shown.

The valve blocks 46*a* and 46*b* will now be described in conjunction with FIG. 3, taking one valve block 46 as an example. This valve block includes a cylindrical valve body 52. In it, there is a valve chamber 54, which communicates with the work chamber 44 via a connecting conduit 56. A bore 57 that is coaxial with the axis of the valve body 52 leads, in the installed position, from the valve chamber 54 in the direction of the work chamber 44. It forms a guide opening 58 for a guide portion 60 of a valve element 62.

A bevel (not identified by reference numeral) in the transition region between the guide opening 58 and the valve chamber 54 forms a valve seat for the valve element 62. The valve seat and the valve element 62 together form an inlet valve 64, through which fuel from the metering unit 20, via the inlet conduit 48 with its portions 66 and 57 embodied in the valve body 52, can reach the valve chamber 54 and beyond to the work chamber 44.

Opposite the guide opening 58, a bore 68 extends from the valve chamber 54; a guide portion 70 of a valve element 72 is guided in it. A bevel (not identified by reference numeral) in the transition region between the bore 68 and the outside of the valve body 52 forms a valve seat for the valve element 72. The valve seat and the valve element 72 together form an outlet valve 74, by way of which the fuel from the work chamber 44, via the connecting conduit 56, the valve chamber 54, and the outlet conduit 50, can reach the fuel line 23 and beyond to the rail 24.

A blind bore 76 is made in the valve element 72 of the outlet valve 74, toward the valve chamber 54. A compression spring 80 is braced on the bottom 78 of this bore. The other end of the compression spring rests on a shoulder 82 of the valve element 62 of the inlet valve 64. In this way, the valve element 62 of the inlet valve 64 is pressed against its valve seat. The valve element 72 of the outlet valve 74 is urged against its valve seat by a compression spring 84.

Figure 4:
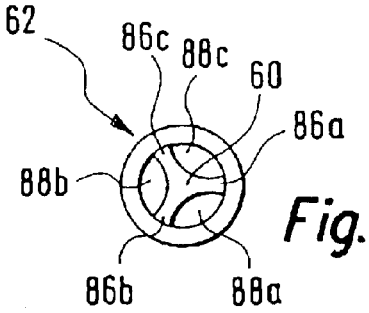
FIG. 4 is a plan view of a valve element of the inlet valve of FIG. 3.
Figure 5:
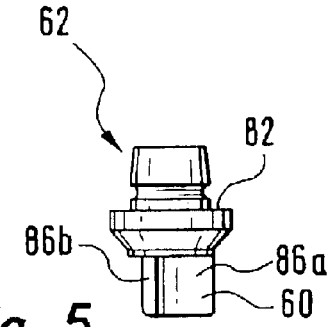
FIG. 5 is a side view of the valve element of FIG. 4.

The guide portion 60 of the valve element 62 of the inlet valve 64 is embodied, as can be seen from FIGS. 4 and 5, in the form of vanes 86*a*, 86*b* and 86*c*, which extend radially in a star pattern and are distributed over the circumference. On their radially outer ends, the vanes 86*a*, 86*b* and 86*c* are embodied such that a markedly reduced contact with the wall of the guide opening 58 in the valve body 52 results. Between the vanes 86*a*, 86*b* and 86*c*, recesses 88*a*, 88*b* and 88*c*, respectively, that are ground hollow are present.

The fuel system 10 with the high-pressure fuel pump 22 functions as follows: The metering unit 20 is triggered by the open- and closed-loop control unit 34 in such a way that only the quantity of fuel that is injected by the injectors 26 into the combustion chambers 28 reaches the high-pressure fuel pump 22 and from there reaches the rail 24. During the intake phase of a cylinder 36*a* and 36*b*, the piston 40*a* and 40*b*, respectively, moves radially inward, so that the pressure in the corresponding work chamber 44*a* and 44*b* drops. As a result, the pressure in the valve chamber 54 drops as well, and in turn causes the valve element 62 of the inlet valve 64 of the corresponding cylinder 36*a* and 36*b* to lift from its seat.

Thus fuel can flow from the metering unit 20 into the work chambers 44*a* and 44*b*. The reaction of the valve element 62 of the inlet valve 64 takes place quite spontaneously, since the friction between the guide portion 60 and the guide opening 58 is only very slight. At the same time, the valve element 62 is centered exactly in the guide opening 58 by the guide portion 60, so that in the closed state, it reliably seals off the communication between the valve chamber 54 and the inlet conduit 48. The recesses 88*a*, 88*b* and 88*c*, when the inlet valve 64 is open, enable a largely unhindered inflow of the fuel to the work chamber 44*a* and 44*b*.

During the pumping phase of a cylinder 36*a* and 36*b*, the corresponding piston 40*a* and 40*b* moves radially outward. As a result, the pressure in the valve chamber 54 rises, so that the valve element 62 of the inlet valve 64 comes back into contact with its valve seat. Once the pressure difference between the valve chamber 54 and the outlet conduit 50 is great enough, the valve element 72 of the outlet valve 74 lifts from the corresponding valve seat, so that the fuel from the work chamber 44 can reach the rail 24 via the valve chamber 54. It is clear from this that a motion of the valve element 72 of the outlet valve 74 has no direct effect on the valve element 62 of the inlet valve 64. Only the compression spring 80 is relaxed somewhat, but because of the high pressure prevailing in the valve chamber, this has no influence on the position of the valve element 62.

Figure 6:
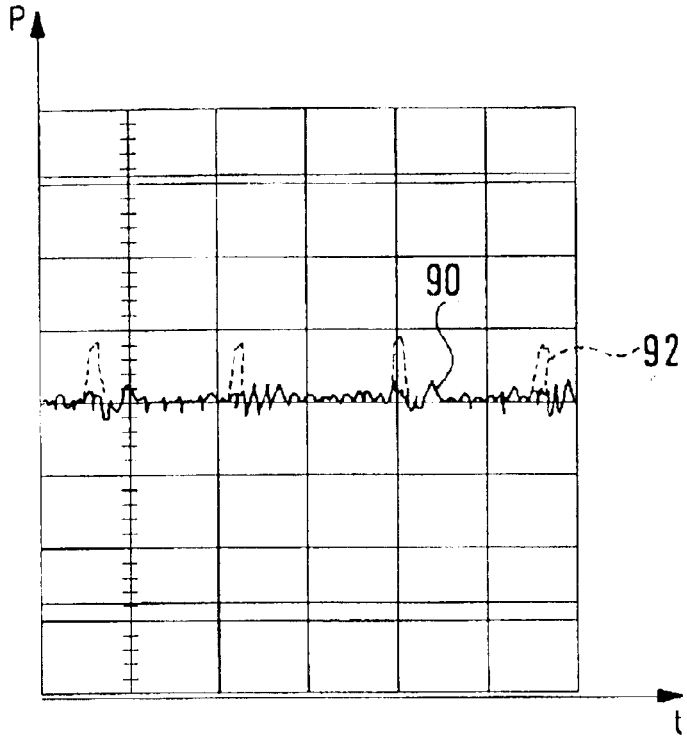
FIG. 6 is a graph showing the pressure in an inlet conduit of the high-pressure fuel pump of FIG. 2 over time.

When no fuel from the injectors 26 reaches the combustion chambers 28 (as in the overrunning mode, for instance), the metering unit 20 is closed by the open- and closed-loop control unit 34. However, for systematic reasons, when the metering unit 20 is closed a certain leakage quantity of fuel occurs, which via the fuel line 21 reaches the inlet conduits 48*a* and 48*b*. However, since the inlet valve 64 is decoupled from the outlet valve 74, the inlet valve 64 remains reliably closed in this case as well, and so no fuel is pumped into the rail 24. The corresponding pressure course is identified by reference numeral 90 in FIG. 6.

The decoupling assures that during the pumping stroke of the cylinder 36*a*, for instance, the valve element 62 of the inlet valve 64 in this cylinder does not lift from its valve seat, and thus does not trip any pressure pulse in the inlet conduits 48*a* and 48*b*. Since the cylinder 36*b* is in an intake phase when the cylinder 36*a* is in a pumping phase, such a pressure pulse could easily cause the valve element 62 of the inlet valve 64 of the cylinder 36*b* to lift from its seat.

The result would be that leak fuel from the metering unit 20 would reach the work chamber 44*b* of the corresponding cylinder 36*b* and be pumped onward to the rail 24. These pressure pulses, which in the high-pressure fuel pump 22 are avoided in the inlet conduits 48*a* and 48*b*, are represented by dashed lines in FIG. 6 and identified by reference numeral 92.

Figure 7:
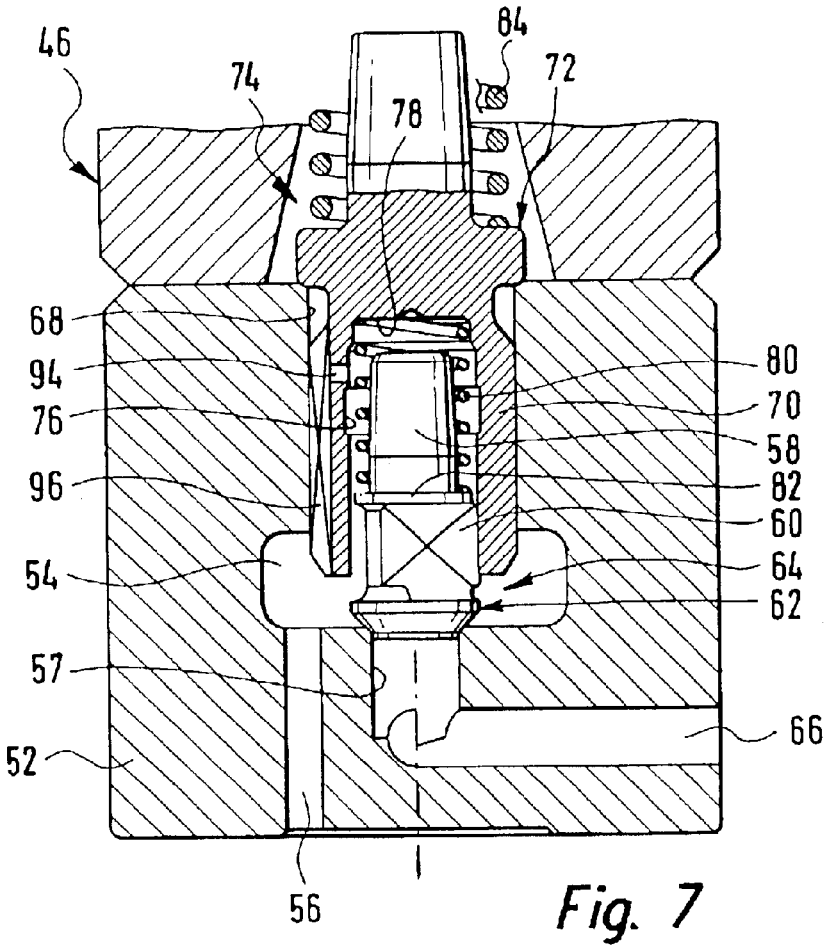
FIG. 7 is a detail similar to FIG. 3 of an alternative exemplary embodiment of a high-pressure fuel pump.

In FIG. 7, a valve body 52 of a second exemplary embodiment of a high-pressure fuel pump 22 is shown. In FIG. 7, those elements and regions that have functions equivalent to the exemplary embodiment described above are identified by the same reference numerals. They will not be described again in detail.

In the exemplary embodiment shown in FIG. 7, the valve element 62 of the inlet valve 64 is guided in the blind bore 76 of the valve element 72 of the outlet valve 74. This blind bore accordingly forms the guide opening 58. This has the advantage that a conventional valve element 72 can be used for the outlet valve 74. For bracing the compression spring 80 on the valve element 62, a disk 82 is provided, which rests on the axial edges of the vanes 86*a*, 86*b* and 86*c*. For equalizing the pressure in the guide opening 58, a pressure equalizing bore 94, which communicates with the valve chamber 54 via a longitudinal groove 96, is provided in the wall of the valve element 72 surrounding the guide opening.

Figure 8:
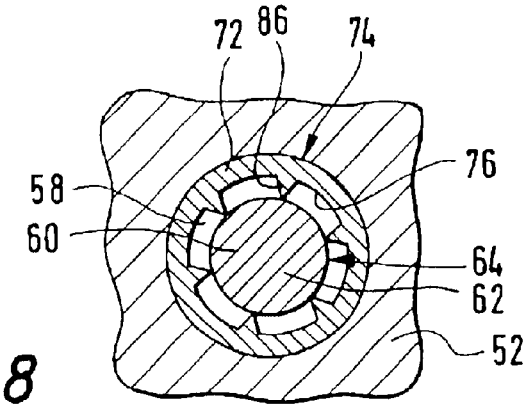
FIG. 8 is a section through a region of a third exemplary embodiment of a high-pressure fuel pump.

FIG. 8 shows one region of a modification of the inlet valve 64 shown in FIG. 7 and of the outlet valve 74 shown in FIG. 7. Here there are no vanes on the guide portion 90 of the valve element 62 of the inlet valve 64. Instead, ribs 86 tapering to a point extend from the radially inner circumferential wall of the blind bore 76 of the valve element 72 of the outlet valve 74.

The foregoing relates to preferred exemplary embodiments of the invention, it being understood that other variants and embodiments thereof are possible within the spirit and scope of the invention, the latter being defined by the appended claims.

I claim:

1. A fuel pump (22), in particular for an internal combustion engine (12) with direct injection, the pump comprising a housing (38), at least one piston (40) which is received in the housing (38), drive means (42), which put the piston (40) into a reciprocating motion, a work chamber (44) which is defined in some regions by the piston (40), an inlet conduit (48) and an outlet conduit (50), each of which can be made to communicate with the work chamber (44), a first valve device (64) between the work chamber (44) and the inlet conduit (48)

a second valve device (74) between the work chamber (44) and the outlet conduit (50), each valve device (64, 74) having a movable valve element the movable valve element (62) of one valve device (64) having a guide portion (60), which is received at least in some regions in a guide opening (58), embodied in the movable valve element (72) of the other valve device (74), and the circumferential face of the guide portion (60) and/or of the guide opening having at least one recess (88), by means of which the contact area between the guide portion (60) and the guide opening (58) is reduced.

2. The fuel pump (22) of claim 1, further comprising a connecting conduit (94, 96) which connects the guide opening (58) with the work chamber (44).

3. A fuel pump (22), in particular for an internal combustion engine (12) with direct injection, the pump comprising a housing (38), at least one piston (40) received in the housing (38), drive means (42), which put the piston (40) into a reciprocating motion, a work chamber (44) which is defined in some regions by the piston (40), an inlet conduit (48) and an outlet conduit (50), each of which can be made to communicate with the work chamber (44), a first valve device (64) between the work chamber (44) and the inlet conduit (48)

a second valve device (74) between the work chamber (44) and the outlet conduit (50), each valve device (64, 74) having a movable valve element, the movable valve element (62) of one valve device (64) having a guide portion (60), which is received in a guide opening (58), the guide portion (60) being embodied on the valve element (62) of the first valve device (64), and the guide opening (58) being embodied in the inlet conduit (48).

4. The fuel pump (22) of claim 3, wherein the circumferential face of the guide portion (60) and/or of the guide opening comprises at least one longitudinally extending recess (88), by which the contact area between the guide portion (60) and the guide opening (58) is reduced and which acts as a flow conduit when the valve device (64) is open.

5. The fuel pump (22) of claim 1, comprising a plurality of said recesses (88).

6. The fuel pump (22) of claim 2, comprising a plurality of said recesses (88).

7. The fuel pump (22) of claim 4, comprising a plurality of said recesses (88).

8. The fuel pump (22) of claim 1, wherein said at least one recess (88) is embodied such that between the guide portion (60) and the guide opening (58), only an essentially linear contact exists.

9. The fuel pump (22) of claim 2, wherein said at least one recess (88) is embodied such that between the guide portion (60) and the guide opening (58), only an essentially linear contact exists.

10. The fuel pump (22) of claim 4, wherein said at least one recess (88) is embodied such that between the guide portion (60) and the guide opening (58), only an essentially linear contact exists.

11. The fuel pump (22) of claim 5, wherein said at least one recess (88) is embodied such that between the guide portion (60) and the guide opening (58), only an essentially linear contact exists.

12. The fuel pump (22) of claim 1, wherein the guide portion (60) is embodied such that it includes at least three radially extending vanes (86), which are distributed over the circumference.

13. The fuel pump (22) of claim 2, wherein the guide portion (60) is embodied such that it includes at least three radially extending vanes (86), which are distributed over the circumference.

14. The fuel pump (22) of claim 5, wherein the guide portion (60) is embodied such that it includes at least three radially extending vanes (86), which are distributed over the circumference, and wherein said plurality of recesses are embodied such that the guide opening (58) is embodied such that it includes at least three radially extending ribs (86), which are preferably distributed over the circumference.

15. The fuel pump (22) of claim 1, the guide opening (58) is embodied such that it includes at least three radially extending ribs (86), which are distributed over the circumference.

16. The fuel pump (22) of claim 2, the guide opening (58) is embodied such that it includes at least three radially extending ribs (86), which are distributed over the circumference.

17. The fuel pump (22) of claim 12, wherein the vanes (86) are ground hollow.

18. The fuel pump (22) of claim 15, wherein the vanes (86) are ground hollow.

19. The fuel pump (22) of claim 1, wherein the valve element (62) of the first valve device (64) is braced on the valve element (72) of the second valve device (74) via a clamping element (80) in such a way that it is pressed against the associated seat.

20. The fuel pump (22) of claim 19, wherein the first valve element (62) comprises a plate-shaped support portion, preferably a disk (82), on which the clamping element (80) is braced.

* * * * *